US005606331A

United States Patent [19]

McCorkle

[11] Patent Number: 5,606,331

[45] Date of Patent: *Feb. 25, 1997

[54] MILLENNIUM BANDWIDTH ANTENNA

[75] Inventor: John McCorkle, Laurel, Md.

[73] Assignee: The United States of America as represented by the Secretary of the Army, Washington, D.C.

[ * ] Notice: The term of this patent shall not extend beyond the expiration date of Pat. No. 5,471,223.

[21] Appl. No.: 418,715

[22] Filed: Apr. 7, 1995

[51] Int. Cl.[6] ..... H01Q 13/02

[52] U.S. Cl. ..... 343/786; 343/772

[58] Field of Search ..... 343/772, 786; H01Q 13/00, 13/02, 13/06

[56] References Cited

U.S. PATENT DOCUMENTS

| | | | |
|---|---|---|---|
| 3,400,404 | 9/1968 | Kreutel, Jr. | 343/786 |
| 3,831,176 | 8/1974 | Epis et al. | 343/786 |
| 4,667,205 | 5/1987 | Gehin | 343/786 |
| 4,929,962 | 5/1990 | Bëgout et al. | 343/786 |
| 5,471,223 | 11/1995 | McCorkle | 343/786 |

FOREIGN PATENT DOCUMENTS

| | | | |
|---|---|---|---|
| 0082507 | 6/1980 | Japan | 343/786 |

*Primary Examiner*—Michael C. Wimer
*Assistant Examiner*—Tan Ho
*Attorney, Agent, or Firm*—Freda L. Krosnick; Frank J. Dynda

[57] ABSTRACT

An antenna for radiating UWB RF pulses is disclosed. The antenna may include a transverse electromagnetic mode (TEM) horn antenna section connected to a pair of a resistively loaded parallel plates. Each of a pair of protrusions may be connected one of the parallel plates and a shunt network is connected to the parallel plates. Each of said parallel plates includes a plurality of plate segments having varying widths. The protrusions may have a geometric shape such as a quadrilateral, rectangle, square semi-circle or triangle. The protrusions may be made of metal such as copper or aluminum or a resistive material such as carbon. Alternatively, the protrusion may be made of plated PC board such as glass epoxy or duoroid, a carbon composite or fiber glass plated with a conductive material such as copper, tin or carbon. This invention may also be used for narrow band applications, as the shunt network can be tuned to null certain frequency ranges.

19 Claims, 8 Drawing Sheets

MILLENNIUM BANDWIDTH ANTENNA

CROSS-REFERENCE TO RELATED PATENT APPLICATION

This application is related to U.S. patent application Ser. No. 08/160,304 by the instant inventor and filed on Dec. 1, 1993 now U.S. Pat. No. 5,471,223.

BACKGROUND OF THE INVENTION

1. Field of the Invention

The present invention relates to radiating Ultra Wide Bandwidth (UWB) radio frequency (RF) pulses through an antenna for use in communication systems and sensors such as radars and, more particularly, for use in impulse radar systems.

2. Description of the Prior Art

Impulse radar is used in a variety of radar systems in order to determine the location of aircraft, ground vehicles, people, mines, buried pipes, roadway faults and tunnels. A problem that arises in connection with the use of impulse radar is the reflection of the transmitted pulse from the transmitting antenna itself, due to poor return loss in the antenna. Return loss is defined to be the ratio of the energy reflected relative to the energy incident on a port. The reflected pulse causes an exponentially decaying oscillation as the pulse reflects back and forth between the transmitter and the antenna. This oscillation can be so strong and last so long that it masks the intended target.

Common methods for minimizing this oscillation problem are: (1) add a loss to the transmission line; (2) add a loss to the antenna; and (3) design a transmitter that will terminate the reflected wave. Approaches (1) and (2) have the disadvantage of wasting a portion of the transmitter power. Approach (3) has resulted in inefficient bulky designs.

Wicks and Antonik in a paper entitled "Polarization Diverse Ultra-Wideband Antenna Technology" describe a UWB antenna design having a truncated cone shaped ground plane surrounded symmetrically by four radiating elements. This paper is expressly incorporated by reference into the instant application. FIG. 9 of the paper shows a feed arrangement with an adjustable phase shifter for achieving multiple polarizations. FIG. 4 of the paper shows this antenna does not have a substantially flat impedance as time approaches infinity. This paper is contained in *Ultra-Wideband, Short-Pulse Electromagnetics*, edited by H. Bertoni et al., Plenum Press, 1993.

An effective solution for approach (2) involves adding a resistively loaded parallel plate section to the end of a Transverse Electric Magnetic (TEM) horn and adding a shunt network having a shorting wire in series with resistors in the resistively loaded parallel plate section, as set forth in pending U.S. patent application Ser. No. 08/160,304 by the instant inventor. Nonetheless, it is desirable to have an antenna that further minimizes losses while achieving higher return loss and more gain.

SUMMARY OF THE INVENTION

It is therefore an object of the invention to provide an antenna that efficiently radiates yet terminates all energy put into it—including D.C. The foregoing and other objects are attained in accordance with the invention by adding two fins or protrusions to the output of a TEM horn antenna section. These protrusions, in combination the resistively loaded parallel plate section and a shunt network composed of a nichrome wire (#40 in the test unit, which is the preferred embodiment) and resistors, produce an antenna that measured 4 dB greater gain, and better return loss than a similar antenna with resistive plates and a shunt network made with #28 copper wire and resistors.

The Nichrome wire in the shunt network serves as a lossy distributed inductor so that it does not resonate and only minimal resistors are added to bring the DC horn resistance to 200 ohms. Therefore, the network terminates the low frequencies, so low frequency waves are not reflected.

The foregoing and other objects and advantages of the invention will appear from the following description. In the description, reference is made to the accompanying drawings which form a part hereof, and in which there is shown by way of illustration and not of limitation a preferred embodiment. Such description does not represent the full extent of the invention, but rather the invention may be employed in different arrangements according to the breadth of the invention.

DESCRIPTION OF THE PREFERRED EMBODIMENTS

Figure 1:
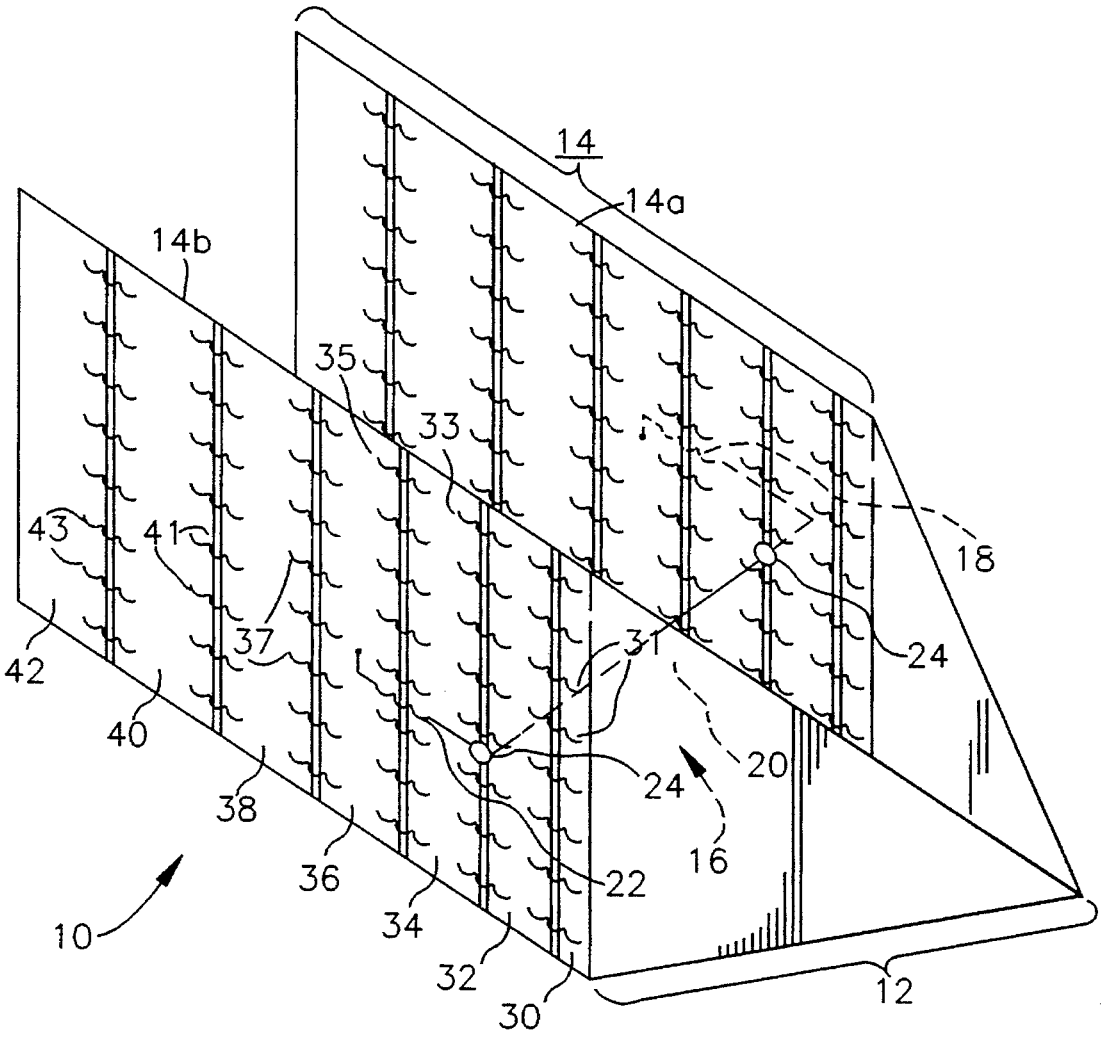
FIG. 1 shows a perspective view of a millennium bandwidth antenna according to the invention with protrusions removed for purposes of clarity only.
Figure 2:
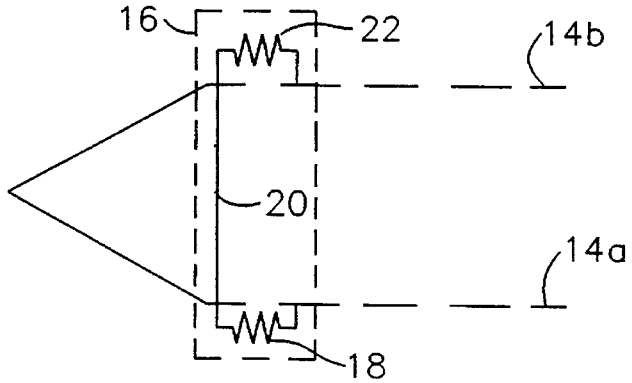
FIG. 2 shows a schematic view of the invention according to FIG. 1 with the protrusions removed for purposes of clarity only.

Referring now to the drawings, like reference numerals represent identical or corresponding parts throughout the several views. A preferred embodiment of Millennium Bandwidth Antenna 10 includes a constant impedance TEM horn antenna section 12 connected to a resistively loaded parallel plate section 14. The illustrated embodiment has a pair of resistively loaded parallel plates 14*a*, 14*b*. A shunt network 16 may connect the parallel plates. The shunt network may include resistors 18, 22 on the outside of the antenna, nichrome wire 20, and internal resistors. It is contemplated by the inventor to utilize the shunt network and/or protrusions, as described hereinafter, with other antenna sections such as TEM mode, short axial length horn as set forth by J. L. Kerr, "Short Axial Length Broadband Horns", IEEE "Trans. Vol., AP-21, Sep. 1973, pp. 710–714, and other like antenna structures. For example, the antenna described in the above paper by Wicks and Antonik may be enhanced by adding the instant shunt network across each pair of opposed radiators.

Figure 5:
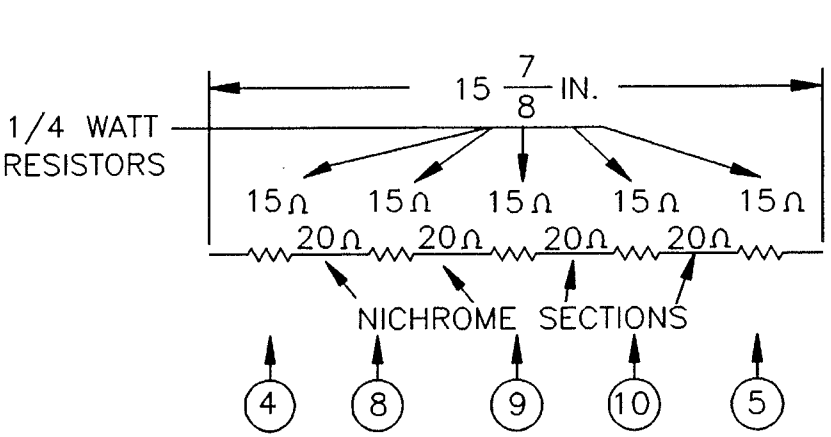
FIG. 5 shows a plan view of the electrical connection of FIG. 4, the connection is depicted in a linear arrangement for purposes of clarity only.
Figure 4:
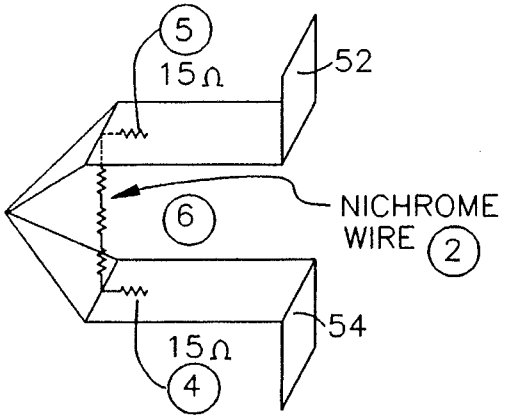
FIG. 4 shows a perspective view of the invention including a electrical connection, which has a U-shaped configuration, and connects two parallel resistive plates.
Figure 7:
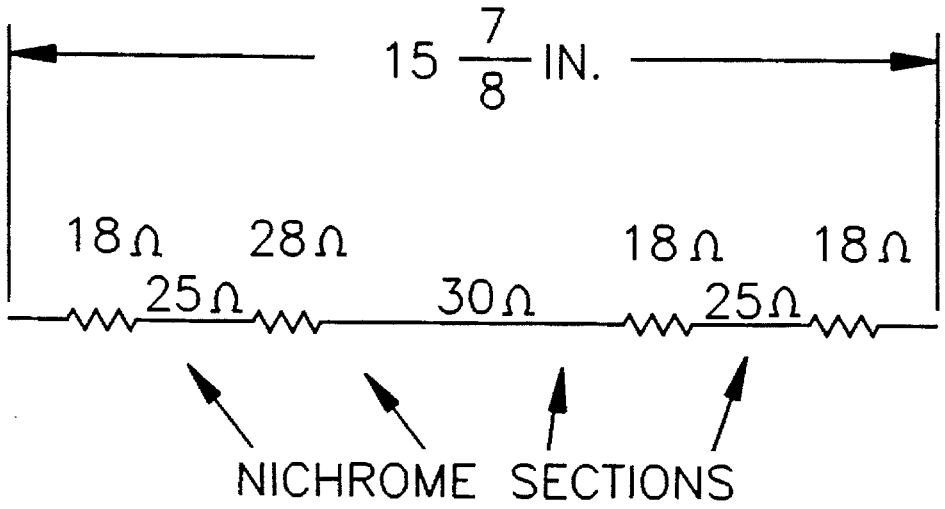
FIG. 7 shows a plan view of the electrical connection of FIG. 6, the connection is depicted in a linear arrangement for purposes of clarity only.
Figure 6:
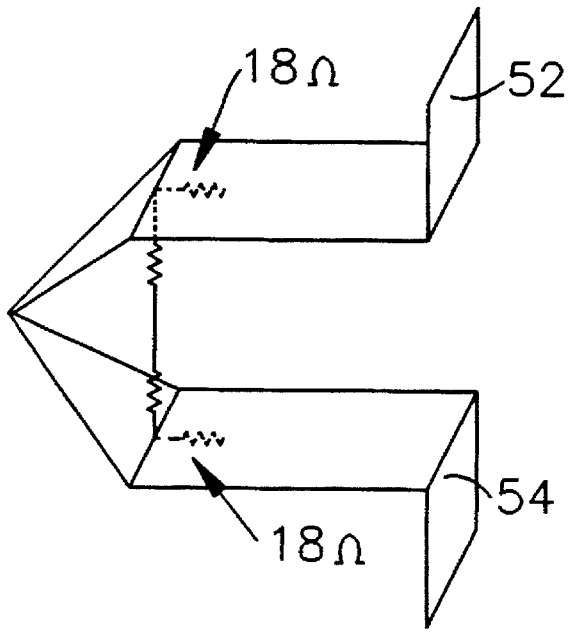
FIG. 6 shows a perspective view of an alternate embodiment of the invention including an electrical connection having two resistors and Nichrome wire located between two parallel resistive plates.

FIGS. 4 and 5 show a shunt network having five resistors and Nichrome wire. Each plate 14*a*, 14*b* has a resistor (18 or 22) located along its outer surface and three resistors are located between the plates. FIGS. 6 and 7 show an alternate embodiment of the shunt network. Only two resistors are provided between the plates. The alternate embodiment of the shunt network has four resistors, i.e., one resistor along the outside of each plate and the two internal resistors along the Nichrome wire.

Experimental results have shown the two internal resistor embodiment is superior to the three internal resistor embodiment and yields a cleaner launched pulse. Each of the resistively loaded parallel plates may have varying length segments connected through spaced resistors as shown in FIGS. 1 and 3.

Figure 9:
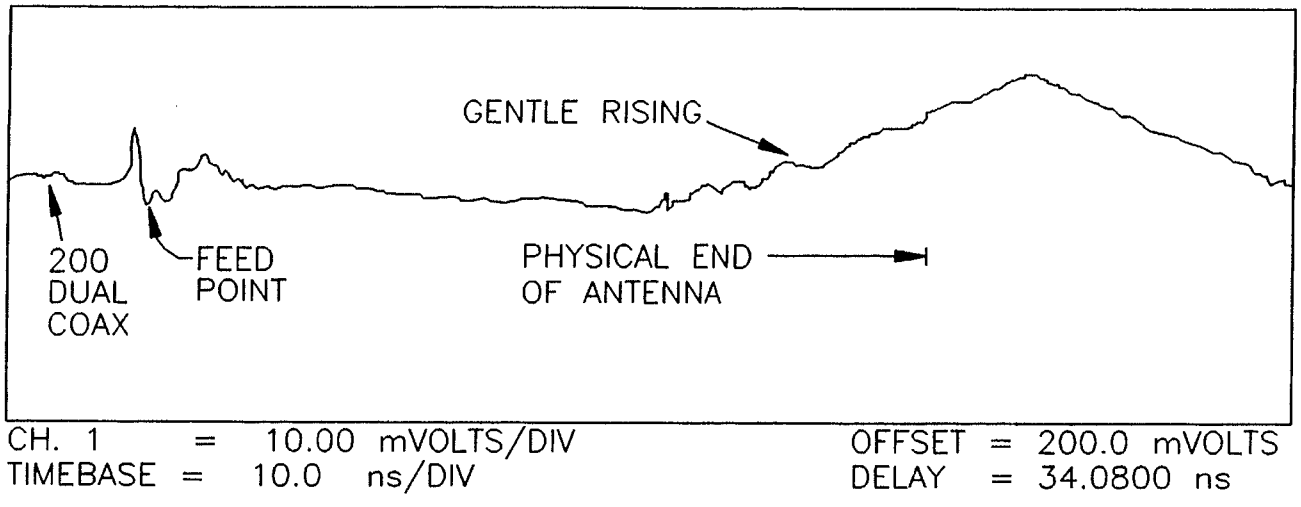
FIG. 9 shows a graph from a time domain reflectometer with substantially constant impedance after an impulse is launched from an antenna.
Figure 8:
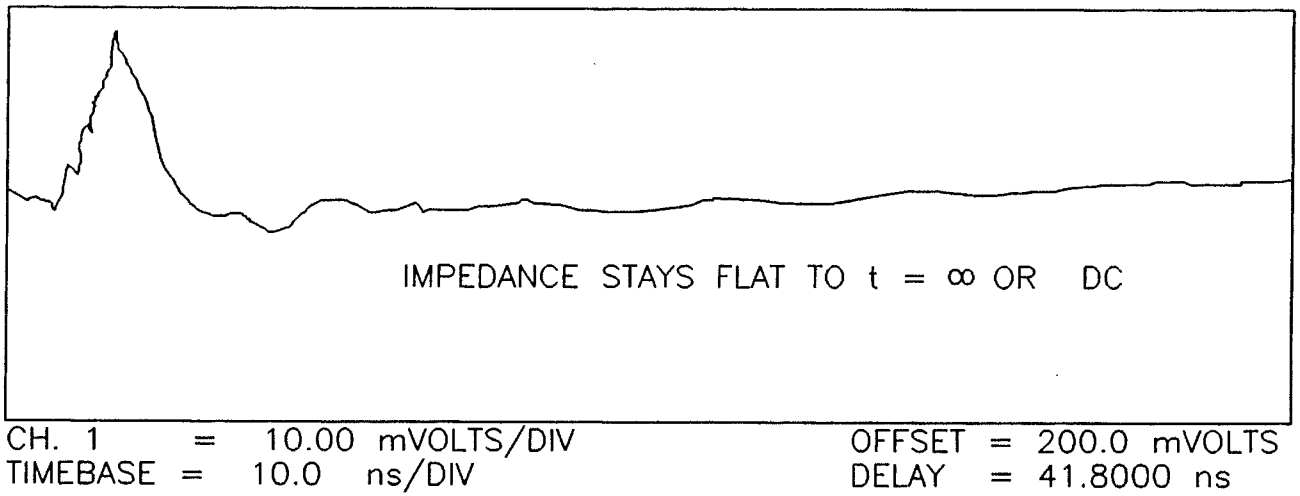
FIG. 8 shows an output graph from a time domain reflectometer showing decreasing impedance after the physical end of the antenna.
Figure 10:
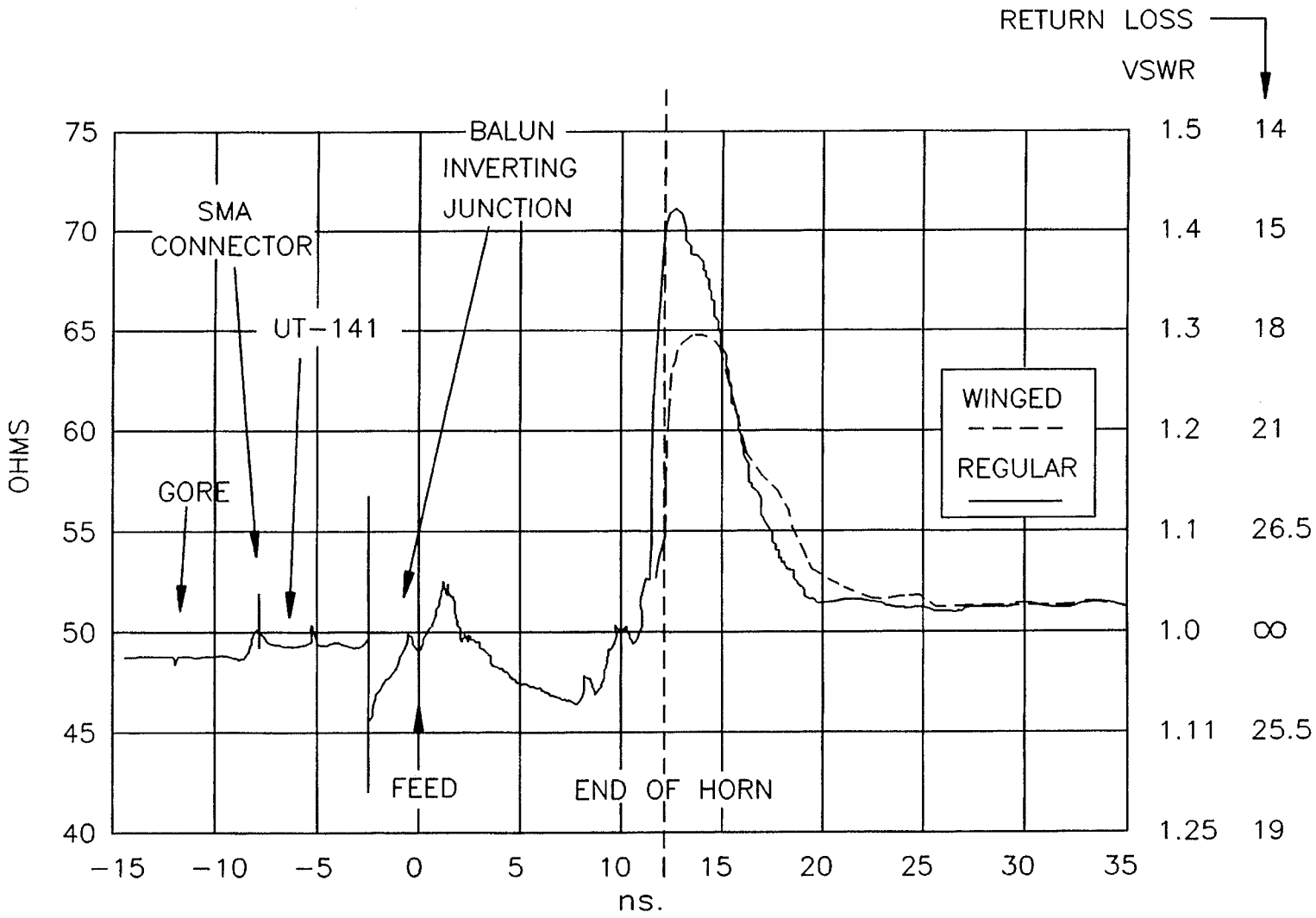
FIG. 10 shows a comparison of impedance and return loss between an antenna having protrusions and an antenna without protrusions.
Figure 11:
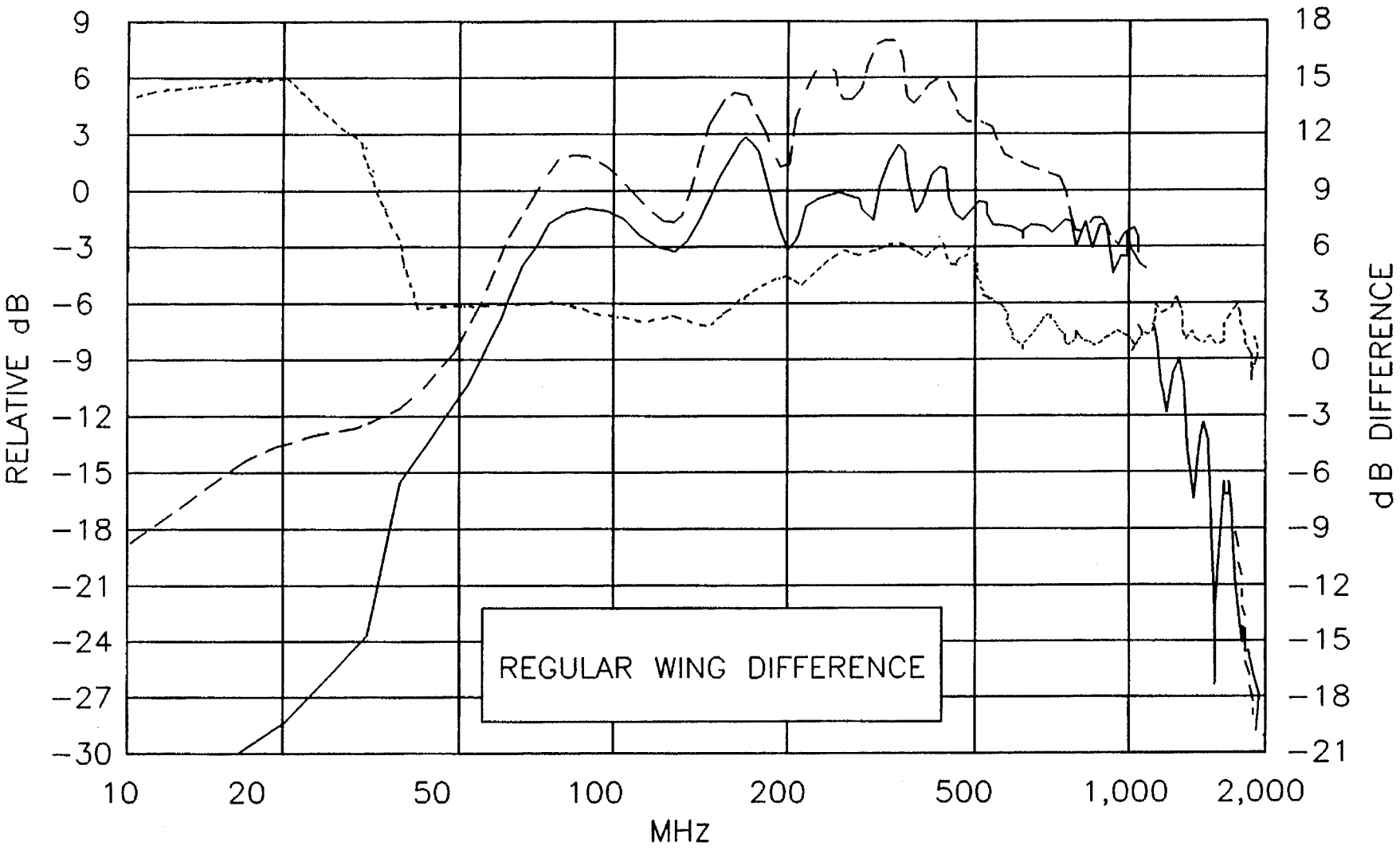
FIG. 11 shows a comparison of gain between an antenna having protrusions and an antenna without protrusions.

A pulse launched into the horn at the apex travels out of the horn, hits the parallel plates—which are coupled via the resistors—and amidst those plates hits the shunt network, and finally hits fins or protrusions 52, 54, 56. The shunt network is primarily a very thin lossy wire which minimally interacts with the high frequency energy (above about 30 MHz for the test antenna) yet dissipates low frequency energy (below about 30 MHz for the test antenna). The fins provide additional capacitive loading that work in combination with the shunt network including Nichrome wire and resistors to produce an antenna with extremely flat impedance versus frequency characteristics. The net result is that all the energy launched into the antenna is either terminated or radiated, so very little energy is reflected as shown in FIGS. 8, 9 and 10.

Figure 3:
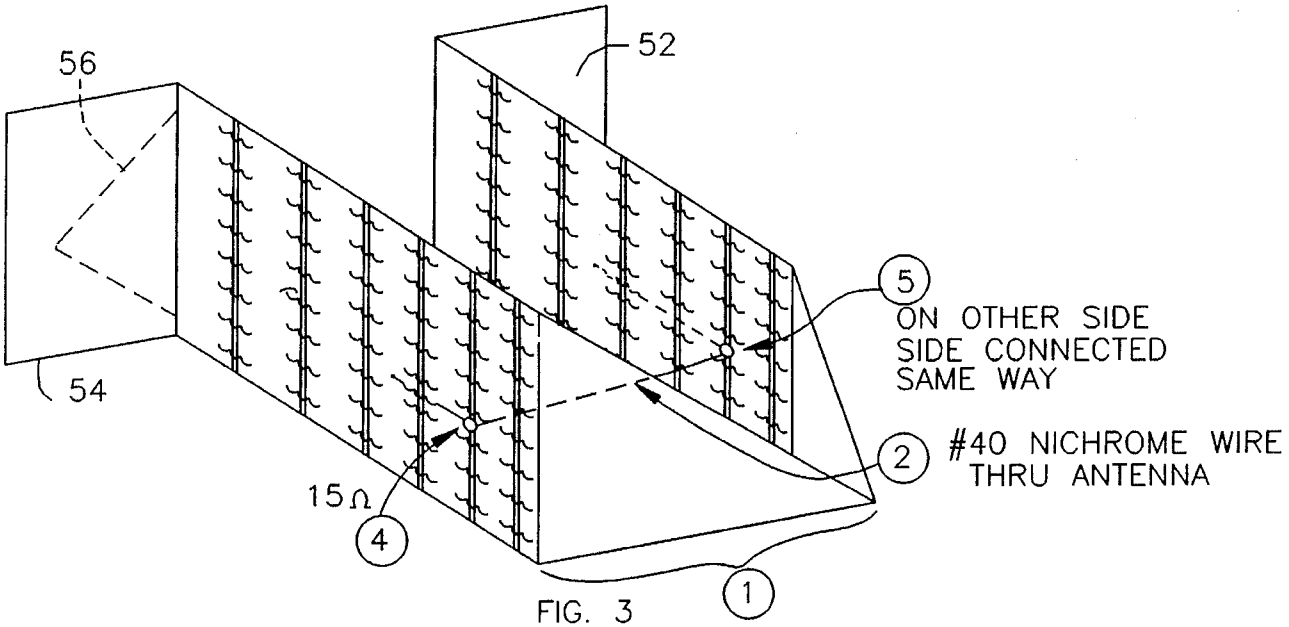
FIG. 3 shows a perspective view of the invention including the protrusions.

FIGS. 3 and 4 show protrusions 52, 54 having a rectangular shape in accordance with the preferred embodiment. According to the preferred embodiment, each protrusion is about eight inches wide and nine inches long. The nine inch length extends away from an associated resistive parallel plate. Although the drawings show the protrusions having the same width of the resistive parallel plates, the protrusions may have a different, i.e., smaller or larger width than the plates. A protrusion according to the preferred embodiment has a thickness of about one-sixteen of an inch. The thickness of a protrusion should generally be less than one-tenth of a wavelength at the highest frequency of a signal radiating from the antenna unless a radiation mode due to the thickness is desired. It is also contemplated to provide protrusions or fins of other geometric shapes such as triangles 56 (shown in dashed lines) and squares.

The protrusions accomplish several functions to improve the antenna. First, they provide capacitive loading, from an impedance standpoint, at the output end of the antenna by providing additional surface area. This loading works together with the shunt network to give the antenna extremely low return loss. Second, they increase the effective aperture dimension which increases the gain. Third, there is a TEM mode field between the plates of the horn with the E-field pointing vertically from the negative plate to the positive plate. Externally, above and below the opening of the horn, there is an E-field oriented vertically, but pointing opposite to the E-field between the plates at the horn opening. These inverted fields partially cancel the radiation emanating from the throat of the horn. The protrusions block this inverted field which effectively increases the gain of the antenna.

According to the preferred embodiment the protrusion should be electrically conductive and designed to have low weight and high strength. The protrusions may be formed from copper, aluminum, plated PC board such as glass epoxy or duoroid, fiber glass plated with copper, tin or other electrically conductive material or a carbon composite that is electrically resistive but remains electrically conductive.

As shown in FIG. 3, each protrusion and a parallel plate defines an included angle of 90°. To manipulate the return loss function (see FIG. 6) the length, area or shape of the protrusion may be varied. It is also possible to vary the angle between the protrusion and parallel plate to adjust the peak return loss. These variations allow tradeoffs to be made between the output pulse shape and the return loss function. Typically, these are adjusted so as to simultaneously minimize the peak return loss, minimize the derivative of the return loss, maximize the peak radiated field, and minimize ringing in the radiated field. The preferred embodiment illustrates the inventor's choice to balance these performance features.

According to the preferred embodiment, each resistive plate section is approximately 15 inches long with seven plate segments. Plate segment 30 may be ⅛ inch long and plate segment 32 may be ¾ inch long. Plate segment 34 may be 1¼ inch long and plate segment 36 may be two inches long. Plate segment 38 may be 3¼ inch long and plate segment 40 may be four inches long. Plate segment 42 may be 4⅛ inch long. About one-eighth of an inch gap exists between plate segments with a resistive component connecting adjacent plate segments. The illustrated embodiment uses sets of eight resistors to distribute the resistance. Thus, six sets of resistors connect the seven plate segments. Each resistor in a set may have the same value. A resistive adhesive would also be acceptable. Segments 30, 32 are joined by a set 31 of 37.4 ohm resistors. Segments 32, 34 are joined by a set 33 of 90.9 ohm resistors. Segments 34, 36 are joined by a set 35 of 154 ohm resistors. Segments 36, 38 are joined by a set 37 of 249 ohm resistors and segments 38, 40 are joined by a set 41 of 374 ohm resistors. Segments 40, 42 are joined by a set 43 of 442 ohm resistors.

It has been experimentally determined that a hole 24 should about one-eight of an inch in diameter and located in the gap between plate segments 32, 34 of each plate 14*a*, 14*b*. The hole should be located at approximately the mid-point of the width of each of the parallel plates. This hole location yields the best impedance results for high and low frequency ranges.

Figure 12:
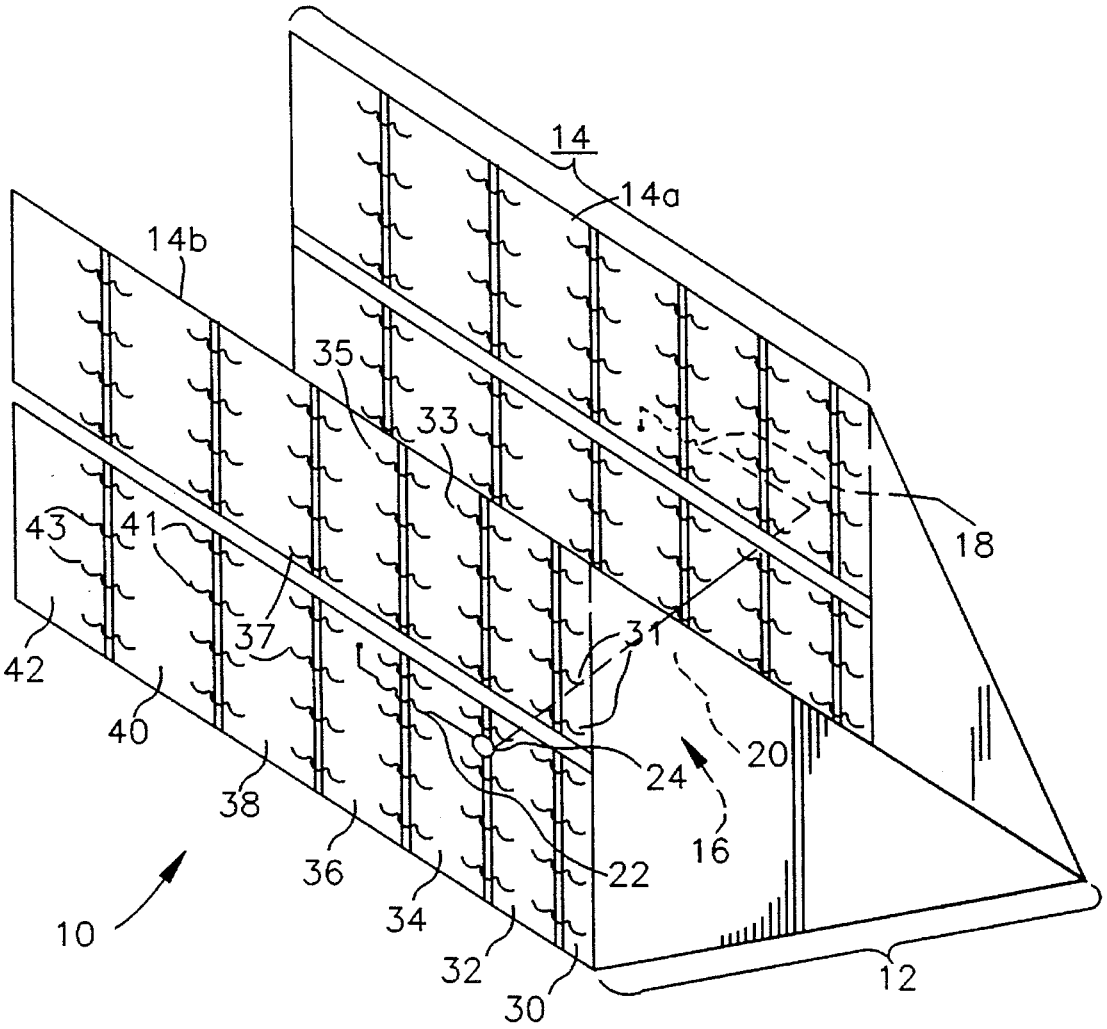
FIG. 12 shows an alternate plate section having four plates.
Figure 13:
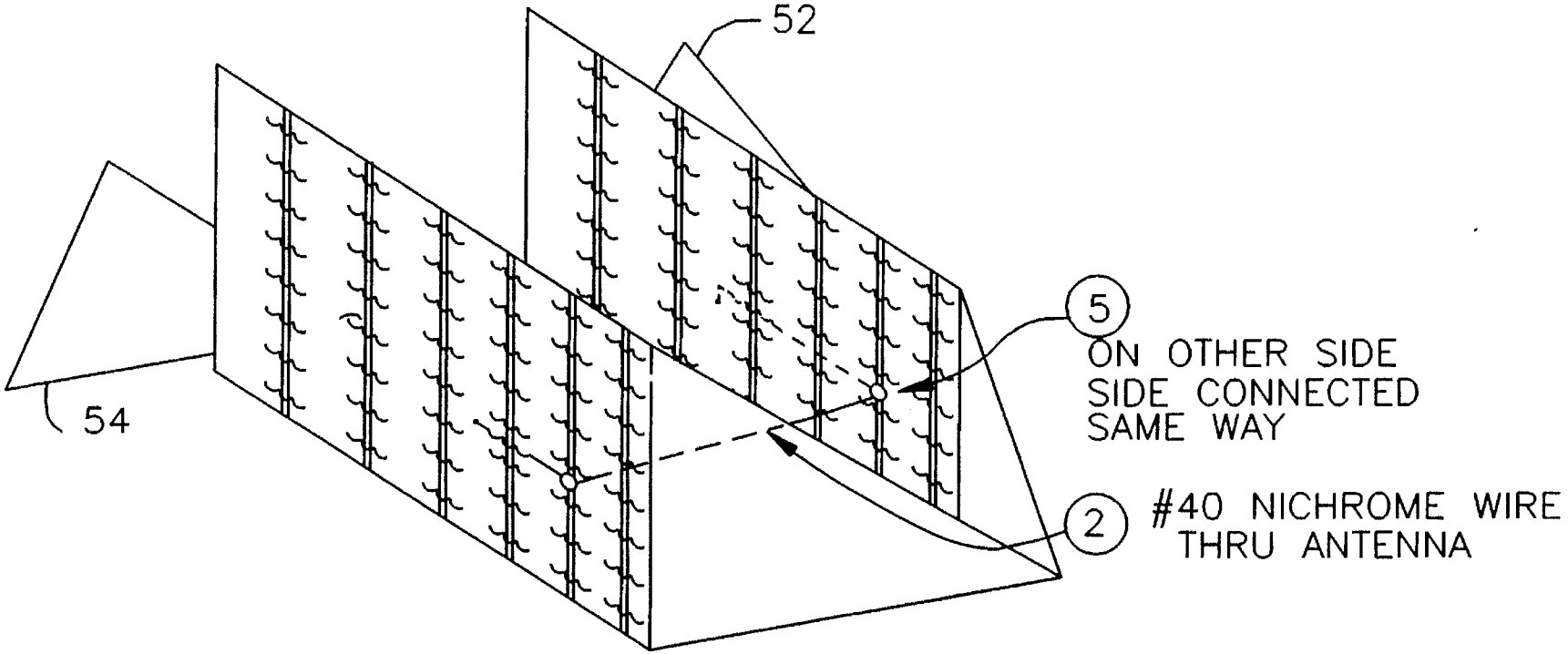
FIG. 13 shows an alternate embodiment with quadrilateral protrusions.

FIG. 12 shows an alternate plate section having four plates. FIG. 13 shows an alternate embodiment with quadrilateral protrusions.

Obviously, numerous modifications and variations of the present invention are possible in light of the above teachings. For example, the fins could be triangular instead of rectangular as shown. The size of the fins and the network might also be tuned together for a particular application specific need. This invention may also be used for narrow band applications, as the shunt network can be tuned to null certain frequency ranges. It is therefore to be understood that within the scope of the appended claims, the invention may be practiced otherwise than as specifically described herein.

What is claimed is:

1. An antenna comprising:

a transverse electromagnetic mode antenna section having an input end and an output end;

a resistively loaded parallel plate section connected to said output end of said transverse electromagnetic mode antenna section, said parallel plate section having a plurality of parallel plates;

a plurality of protrusions, each of said protrusions transversely mounted to one of said parallel plates; and a shunt network electrically connected between said resistively loaded parallel plate section.

2. The antenna according to claim 1, wherein said plurality of parallel plates comprises two parallel plates.

3. The antenna according to claim 2, wherein each of said parallel plates is comprised of a plurality of plate segments having varying lengths.

4. The antenna according to claim 3, further comprising a plurality of resistors connecting said plate segments.

5. The antenna according to claim 1, wherein said shunt network comprises at least a pair of resistors, each resistor connected to a different side of said parallel plate section and a wire connecting said two resistors.

6. The antenna according to claim 1, wherein each of said protrusions has a quadrilateral perimeter.

7. The antenna according to claim 1, wherein each of said protrusions has a triangular perimeter.

8. The antenna according to claim 1, wherein each of said protrusions has a rectangular perimeter.

9. The antenna according to claim 1, wherein at least one of said protrusions is a metal protrusion.

10. The antenna according to claim 9, wherein said metal protrusion is a copper protrusion.

11. The antenna according to claim 1, wherein at least one of said protrusions is a carbon composite protrusion.

12. A low VSWR high efficiency UWB antenna for use in transmitting impulse radar signals comprising:

a transverse electromagnetic mode antenna section having an input end and an output end for radiating said impulse radar signals;

two parallel plates, each formed of a like plurality of plate segments of varying lengths, connected to said output end of said transverse electromagnetic mode antenna section, each of said two parallel plates being resistively loaded by a plurality of resistors;

a pair of protrusions, each of said protrusions connected to one of said parallel plates; and a shunt network connected across said two parallel plates, such that said antenna functions to minimize any reflected impulse radar signals.

13. The antenna according to claim 12, wherein each of said protrusions has a quadrilateral perimeter.

14. The antenna according to claim 12, wherein each of said protrusions has a triangular perimeter.

15. The antenna according to claim 12, wherein each of said protrusions has a rectangular perimeter.

16. The antenna according to claim 12, wherein at least one of said protrusions is a metal protrusion.

17. The antenna according to claim 16, wherein said metal protrusion is a copper protrusion.

18. The antenna according to claim 12, wherein at least one of said protrusions is a carbon composite protrusion.

19. An antenna for radiating UWB RF pulses comprising:

a transverse electromagnetic mode horn antenna section having an input end and an output end;

a resistively loaded parallel plate section connected to said output end of said transverse electromagnetic mode antenna horn section;

a plurality of protrusions, each of said protrusions transversely mounted to said resistively loaded parallel plate section; and a shunt network connected to said resistively loaded parallel plate section.

* * * * *